US008934819B2

(12) United States Patent
Sakamaki et al.

(10) Patent No.: US 8,934,819 B2
(45) Date of Patent: Jan. 13, 2015

(54) DEVELOPING APPARATUS

(75) Inventors: Tomoyuki Sakamaki, Toride (JP); Takanori Iida, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 131 days.

(21) Appl. No.: 13/364,758

(22) Filed: Feb. 2, 2012

(65) Prior Publication Data

US 2012/0201577 A1 Aug. 9, 2012

(30) Foreign Application Priority Data

Feb. 3, 2011 (JP) ..... 2011-021462

(51) Int. Cl.
*G03G 15/09* (2006.01)

(52) U.S. Cl.
CPC ..... *G03G 15/0928* (2013.01)
USPC ..... 399/277

(58) Field of Classification Search
USPC ..... 399/104, 267, 275, 276, 277
See application file for complete search history.

(56) References Cited

U.S. PATENT DOCUMENTS

| | | | | |
|---|---|---|---|---|
| 3,957,016 | A | 5/1976 | Yamada et al. | |
| 3,994,257 | A | 11/1976 | Komori et al. | |
| 6,546,222 | B2 | 4/2003 | Sakemi et al. | |
| 6,850,722 | B2 | 2/2005 | Sakemi et al. | |
| 6,973,281 | B2 | 12/2005 | Hirobe et al. | |
| 6,975,825 | B2 | 12/2005 | Sakamaki et al. | |
| 6,978,108 | B2 | 12/2005 | Sakamaki | |
| 7,099,609 | B2 | 8/2006 | Hirobe et al. | |
| 7,231,154 | B2 | 6/2007 | Sakamaki | |
| 7,321,741 | B2 | 1/2008 | Sakamaki et al. | |
| 7,454,149 | B2 | 11/2008 | Sakamaki | |
| 7,561,838 | B2 | 7/2009 | Sakamaki et al. | |
| 7,653,336 | B2 | 1/2010 | Akashi et al. | |
| 7,725,061 | B2 | 5/2010 | Sakamaki et al. | |
| 7,773,900 | B2 | 8/2010 | Sakamaki | |
| 7,853,186 | B2 | 12/2010 | Akashi et al. | |
| 7,917,069 | B2 | 3/2011 | Sakamaki | |
| 7,991,332 | B2 | 8/2011 | Sakamaki | |
| 2006/0198655 | A1* | 9/2006 | Kotera et al. | 399/104 |
| 2011/0052233 | A1 | 3/2011 | Sakamaki | |

FOREIGN PATENT DOCUMENTS

| | | |
|---|---|---|
| JP | 1-115109 A | 5/1989 |
| JP | 10-91002 A | 4/1998 |

* cited by examiner

*Primary Examiner* — Hoang Ngo
(74) *Attorney, Agent, or Firm* — Fitzpatrick, Cella, Harper & Scinto

(57) ABSTRACT

A developing apparatus includes a developer carrying member for carrying a developer; and a magnetic member including a plurality of magnet pieces disposed inside the developer carrying member along a circumferential direction of the developer carrying member. The magnetic member includes one or more first magnet pieces having the same magnetic polarity at a surface opposing an inner surface of the developer carrying member, and one or more second magnet pieces having the other magnetic polarity opposing the inner surface of the developer carrying member. A total sum of the first magnet pieces is larger than a total sum of the second magnet pieces, and a ratio of the total sum of a volume of the first magnet pieces to a space occupied by the magnetic member is smaller at an end portion than in a central portion with respect to a longitudinal direction of the magnetic member.

9 Claims, 10 Drawing Sheets

(a)

(b)

(a)

(b)

(a)

(b)

(a)

(b)

(a)

(b)

DEVELOPING APPARATUS

FIELD OF THE INVENTION AND RELATED ART

The present invention relates to a developing apparatus which has, in the hollow of its developer bearing member, a non-rotational magnetic member, the lengthwise end portions of which are different in shape from the rest. More specifically, it relates to a structural arrangement for reducing such a developing apparatus in the "edge effect", that is, a phenomenon that the lengthwise end portions of the magnetic member are higher in magnetic flux density.

Some developing devices (apparatuses) have a rotational developer bearing member which bears single-component developer or two-component developer which contains toner. They develop an electrostatic image formed on an image bearing member, into a visible image, that is, an image formed of toner. An image forming apparatus employing such a developing device is widely used.

Generally, a developer bearing member (development sleeve) is made of a nonmagnetic substance. Thus, in order to enable a developer bearing member to magnetically bear developer on its peripheral surface, a magnetic roller is non-rotationally positioned in the hollow of the developer bearing member. The magnetic roller is designed so that its peripheral surface has multiple magnetic poles N and multiple magnetic poles S, which extend from one lengthwise end of the magnetic roller to the other. Thus, the magnetic fluxes which connect between the magnetic pole N and the adjacent magnetic pole S cause the developer bearing member to magnetically bear developer on its peripheral surface.

Japanese Laid-open Patent Application H01-115109 discloses one of the methods for manufacturing a magnetic roller for a developing device. According to this patent application, a magnetic roller is formed by solidly adhering to a supporting shaft, multiple magnets which are roughly fan-shaped in cross-section.

Referring to FIG. 2, a magnetic roller 29 is placed in the hollow of a cylindrical and rotational development sleeve 28 (developer bearing member). Since the distance between the magnetic roller 29 and the inward surface of the development sleeve 28 is uniform, the magnetic roller 29 is shaped in the form of a cylindrical column. Thus, at each of the lengthwise ends of the magnetic roller 29, the magnetic fluxes bend in curvature toward the axial line of the roller 29 as if they are flowing from the adjacencies of the edge of the circular end surface to the center of the circular end surface. Therefore, the edge portions of the magnetic roller 29 are higher in magnetic flux density, being therefore greater in magnetic force, than the inward portions of the magnetic roller 29 in terms of the lengthwise direction of the roller 29.

Therefore, the portions of the peripheral surface of the development sleeve 28, which correspond in position to the lengthwise end surfaces of the magnetic roller 29, one for one, are greater in the amount by which developer is borne on the peripheral surface of the development sleeve 28 than the portion of the peripheral surface of the development sleeve 28, which corresponds in position to the inward portion (center portion) of the magnetic roller 29, in terms of the lengthwise direction of the roller 29. This phenomenon creates the following problems. That is, the lengthwise end portions of the development sleeve 28 are faster in the developer deterioration attributable to the friction between the developer and a development blade 30 for regulating the development layer in thickness, than the rest of the development sleeve 28, and/or an image forming apparatus outputs a print which has unwanted lines which correspond in position to the lengthwise ends of the magnetic roller 29 (Japanese Laid-open Patent Application H10-91002).

One of the solutions to the abovementioned problem is disclosed in Japanese Laid-open Patent Application H10-91002. According to this patent application, the developing device is provided with a cylindrical magnetic roller, and the edge of each of the lengthwise end surfaces of the cylindrical magnetic roller are chamfered to make the magnetic roller uniform in the strength of its magnetic force across its lengthwise range. More specifically, referring to FIG. 7, each of the lengthwise end portions of the magnetic roller 29 is shaped so that the distance between the peripheral surface of the magnetic roller 29 and the developer bearing surface of the development sleeve 28 gradually increases toward each of the lengthwise ends of the development sleeve 28 (magnetic roller 29) to compensate for the aforementioned characteristics of a conventional magnetic roller (which is uniform in diameter across the entirety of its lengthwise range) that its lengthwise end portions are greater in the magnetic force than the rest.

Referring again to FIG. 7, it has been known that a magnetic roller, such as the magnetic roller 29, which is uniform in diameter across the entirety of its lengthwise range, suffers from an unintended problem that when developer is borne on the peripheral surface of the development sleeve 28, it is non-uniformly borne on the lengthwise end portions of the development sleeve 28. More specifically, the following has been observed: across the area of the peripheral surface of the development sleeve 28, which corresponds in position to each of the lengthwise ends of each of the magnetic poles (which are greater in count: magnetic poles N in FIG. 4) became non-uniform in the amount by which developer is borne, because of the higher magnetic flux density, whereas across the area of the peripheral surface of the development sleeve 28, which corresponds in position to each of the lengthwise ends of each of the magnetic poles (which are smaller in count: magnetic poles S in FIG. 4) became non-uniform in the amount by which developer is borne, because of the lower magnetic flux density.

As developer is unintendedly and non-uniformly borne on the peripheral surface of the lengthwise end portions of the development sleeve 28, it is possible that the non-uniformity makes the lengthwise end portions of the development sleeve 28 different from the rest in the efficiency with which an electrostatic static image is developed with developer. Therefore, it is possible that the non-uniformity will make an image forming apparatus output an image which is non-uniform in density. Moreover, the non-uniformity locally increases the pressure between the developer layer regulating blade 30 and the peripheral surface of the development sleeve 28. Therefore, it is possible that the developer deterioration will be accelerated.

SUMMARY OF THE INVENTION

Thus, the primary object of the present invention is to minimize the edge effect of the magnetic roller of a developing apparatus (device). More concretely, it is to provide a developing apparatus (device), the lengthwise end portions of the magnetic roller of which are different in shape, in terms of cross-section, from the rest, and which are significantly smaller in the amount of the edge effect than a developing apparatus (device) in accordance with the prior art.

According to an aspect of the present invention, there is provided a developing apparatus comprising a developer carrying member for carrying a developer; and a magnetic member provided inside said developer carrying member and having magnetic poles arranged in a circumferential direction of said developer carrying member, wherein on a center axis of said developer carrying member outside an end of said magnetic member, there is a region in which a magnetic flux density of a first magnetic polarity converges toward zero; and wherein a ratio of a volume, per unit length in a longitudinal direction, of a portion of said magnetic member which has a surface magnetic pole of a second magnetic polarity which is different from the first magnetic polarity in a longitudinal end portion to that in a longitudinally central portion is smaller than a ratio of a volume, per unit length in a longitudinal direction, of a portion of said magnetic member which has a surface magnetic pole of the first magnetic polarity in a longitudinal end portion to that in a longitudinally central portion.

According to another aspect of the present invention, there is provided a developer carrying member for carrying a developer; and a magnetic member provided inside said developer carrying member and having magnetic poles arranged in a circumferential direction of said developer carrying member, wherein a part of the volume in a radially central side is smaller in a longitudinal end portion than in a longitudinally central portion.

According to a further aspect of the present invention, there is provided a developing apparatus comprising a developer carrying member for carrying a developer; and a magnetic member provided inside said developer carrying member and having magnetic poles arranged in a circumferential direction of said developer carrying member, wherein the numbers of the magnetic poles of a magnetic polarity and another polarity are not equal, and wherein a ratio of a volume, per unit length in a longitudinal direction, of a portion of said magnetic member which has a surface magnetic pole of a second magnetic polarity which is different from the first magnetic polarity in a longitudinal end portion to that in a longitudinally central portion is smaller than a ratio of a volume, per unit length in a longitudinal direction, of a portion of said magnetic member which has a surface magnetic pole of the first magnetic polarity in a longitudinal end portion to that in a longitudinally central portion.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention are described in detail with reference to the appended drawings. The present invention is also applicable to a magnetic roller which is partially or entirely different in structure from those in the preferred embodiments of the present invention, as long as the magnetic roller is structured so that the lengthwise end portions of each of the component magnets of the magnetic roller are different in volume from the rest, and also, that the component magnet whose magnetic pole N is at the peripheral of the magnetic roller and the component magnet whose magnetic pole S is at the peripheral surface of the magnetic roller are different in the volume of their lengthwise end portions.

Further, not only is the present invention applicable to a developing device which uses two-component developer, but also, a developing device which uses single-component developer. Further, not only is the present invention applicable to a developing device which uses two-component developer and is structured so that its development chamber and stirring chamber are vertically stacked, but also a developing device which uses two-component developer and is structured so that its development chamber and stirring chamber are positioned side by side. Further, a developing device in accordance with the present invention is usable by various image forming apparatuses, regardless of their type. For example, it is usable by an image forming apparatus of the so-called tandem type, which has only a single photosensitive drum, an image forming apparatus of the so-called intermediary transfer type, which has a recording medium conveying means, an image forming apparatus which transfers an image directly onto a sheet of recording medium from its image bearing member(s).

Hereafter, the preferred embodiments of the present invention are described only about their essential portions, that is, the portions involved in the formation and transfer of a toner image. However, the present invention is also applicable to image forming apparatuses other than those in the preferred embodiments of the present invention. That is, it is applicable to various printers, copy machines, facsimile machines, multifunction image forming apparatuses, etc., which are combinations of the abovementioned essential portions of the image forming apparatus and additional devices, equipments, frames, etc.

Incidentally, the ordinary items of the developing devices disclosed in Japanese Laid-open Patent Applications H01-115109 and H10-91002 are not going to be illustrated, and are not going to be described in detail.

<Image Forming Apparatus>

Figure 1:
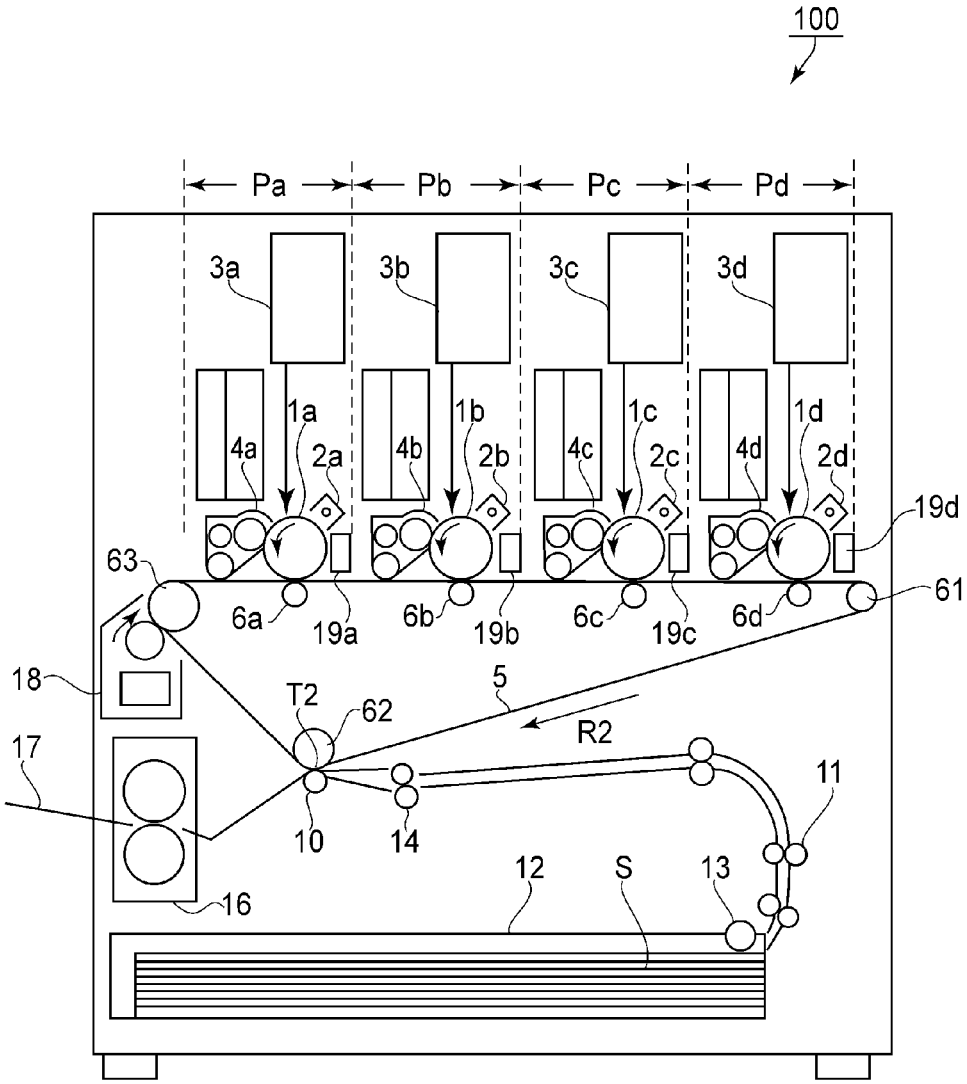
FIG. 1 is a schematic sectional drawing of a typical image forming apparatus compatible with a developing device (apparatus) in accordance with the present invention. It shows the general structure of the apparatus.

FIG. 1 is a schematic sectional drawing of the image forming apparatus in each of the preferred embodiments of the present invention, and shows the general structure of the apparatus. Referring to FIG. 1, an image forming apparatus 100 is a full-color printer of the so-called tandem/intermediary transfer type. It has yellow, magenta, cyan and black image formation stations Pa, Pb, Pc and Pd, and an intermediary transfer belt 5, along which the four image formations Pa, Pb, Pc and Pd are aligned in tandem.

The intermediary transfer belt 5 is supported and kept stretched by rollers 61, 62 and 63. It is circularly movable in the direction indicated by an arrow mark R2. In the image formation station Pa, a yellow toner image is formed on a photosensitive drum 1*a*, and is transferred onto the intermediary transfer belt 5. In the image formation station Pb, a magenta toner image is formed on a photosensitive drum 1*b*, and is transferred onto the intermediary transfer belt 5. In the image formation station Pc, a magenta toner image is formed on a photosensitive drum 1*c*, and is transferred onto the intermediary transfer belt 5. In the image formation stations Pc and Pd, cyan and black toner images are formed, respectively, and are transferred onto the intermediary transfer belt 5.

After the transfer (primary transfer) of the four monochromatic toner images, different in color, onto the intermediary transfer belt 5, the four toner images are conveyed to the secondary transfer station T2, in which they are transferred (secondary transfer) onto a sheet P of recording medium. More specifically, there are multiple sheets P of recording medium stored in a recording medium cassette 12. The sheets P are moved out of the cassette 12 by a pickup roller 13, are separated one by one by a pair of separation rollers 11, and are sent to a pair of registration rollers 14. The registration rollers 14 release and send each sheet P of recording medium to the secondary transfer station T2 with such timing that each sheet P arrives at the secondary transfer station T2 at the same time as the toner image(s) on the intermediary transfer belt 5. After the transfer (secondary transfer) of the toner image(s) onto the sheet P, the sheet P and the toner image(s) thereon are subjected to heat and pressure by a fixing device 16, whereby the toner image(s) are fixed to the surface of the sheet P. Then, the sheet P is discharged into a delivery tray 17.

The image formation stations Pa, Pb, Pc and Pd are roughly the same in structure although they are different in the color of the toner which their developing devices 4*a*, 4*b*, 4*c* and 4*d* use, respectively. Thus, only the image formation station Pa is described about its structure. That is, the description of the image formation stations Pb, Pc and Pd are the same as that of the image formation station Pa except that the suffix "a" of the referential codes for the various items of the image formation station Pa are substituted with "b, c and d", respectively.

The image formation station Pa has a photosensitive drum 1*a*, a charging device 2*a* of the corona type, an exposing device 3*a*, a developing device 4*a*, a primary transfer roller 6*a*, and a drum cleaning device 19*a*. The charging device 2*a*, exposing device 3*a*, developing device 4*a*, and primary transfer roller 6*a* are in the adjacencies of the peripheral surface of the photosensitive drum 1*a*.

The photosensitive drum 1*a* is made up of an aluminum cylinder and a photosensitive layer. The photosensitive layer is formed on the peripheral surface of the photosensitive drum 1*a*. The photosensitive layer is formed of a substance, the intrinsic polarity of which is negative. The photosensitive drum 1*a* is rotated at a preset process speed, in the direction indicated by an arrow mark. The charging device 2*a* uniformly and negatively charges the peripheral surface of the photosensitive drum 1*a* to a potential level VD (pre-exposure potential level). The exposing device 3*a* writes an electrostatic image on the uniformly charged area of the peripheral surface of the photosensitive drum 1*a*, by scanning the uniformly charged area of the peripheral surface of the photosensitive drum 1*a* with a beam of laser light, with the use of its rotating mirror. The developing device 4*a* develops the electrostatic image into a visible image, that is, an image formed of toner, with the use of developer made up of toner and carrier; it forms a toner image on the peripheral surface of the photosensitive drum 1*a*.

The primary transfer roller 6*a* is disposed within the loop which the intermediary transfer belt 5 forms. It is kept pressed against the photosensitive drum 1*a*, with the presence of the intermediary transfer belt 5 between itself and photosensitive drum 1*a*, pressing thereby on the inward surface of the intermediary transfer belt 5. Thus, a transfer station T1 is formed between the photosensitive drum 1*a* and intermediary transfer belt 5. While the sheet P of recording medium is conveyed though the primary transfer station T1, DC voltage is applied to the primary transfer roller 6*a*, whereby the negatively charged toner image on the photosensitive drum 1*a* is transferred (primary transfer) onto the intermediary transfer belt 5. The drum cleaning device 19*a* recovers the transfer residual toner, that is, the toner which remained on the peripheral surface of the photosensitive drum 1*a* by escaping from the primary transfer process.

In the preferred embodiments of the present invention, the photosensitive drum 1*a* used as an image bearing member is a photosensitive drum, the photosensitive layer of which is made of organic photosensitive substance. However, the present invention is also compatible with an inorganic photosensitive member, such as a photosensitive member, the photosensitive layer of which is made of amorphous silicon, or the like. Further, the present invention is also compatible with various charging methods, developing methods, transferring methods, cleaning methods, and fixing methods other than those mentioned above.

<Developing Device>

Figure 2:
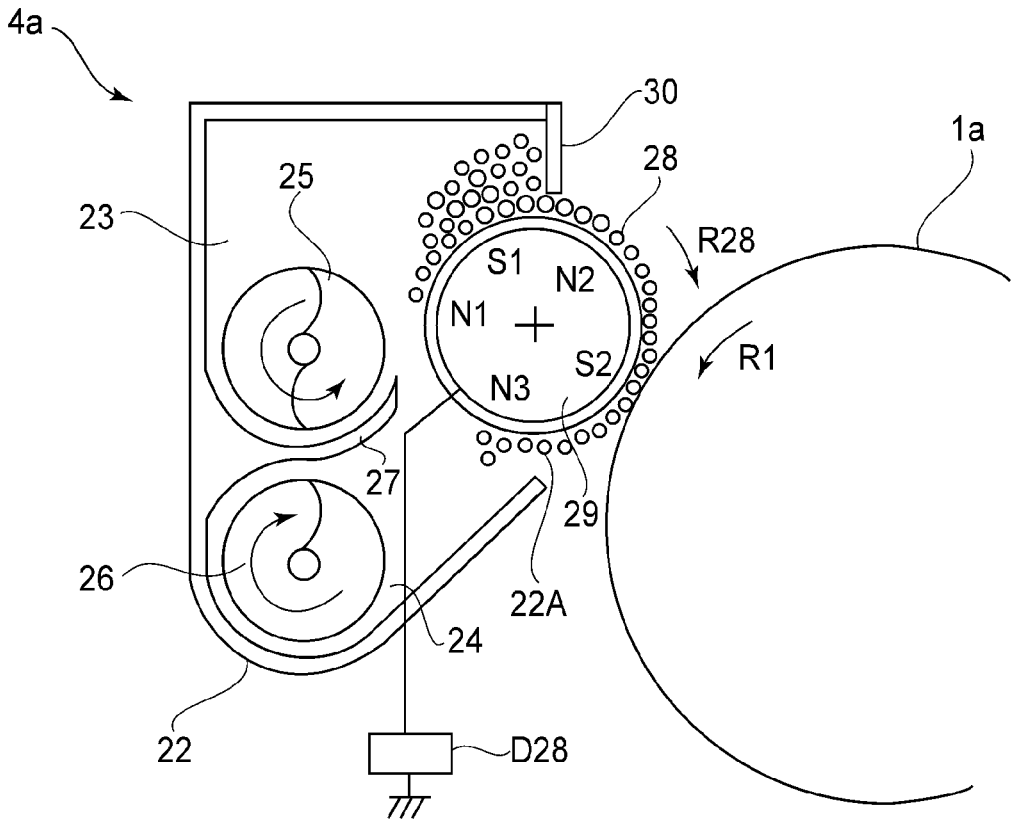
FIG. 2 is a schematic sectional view, at a plane perpendicular to the lengthwise direction of the device, of a typical developing device (apparatus) to which the present invention is applicable. It shows the general structure of the device.
Figure 3:
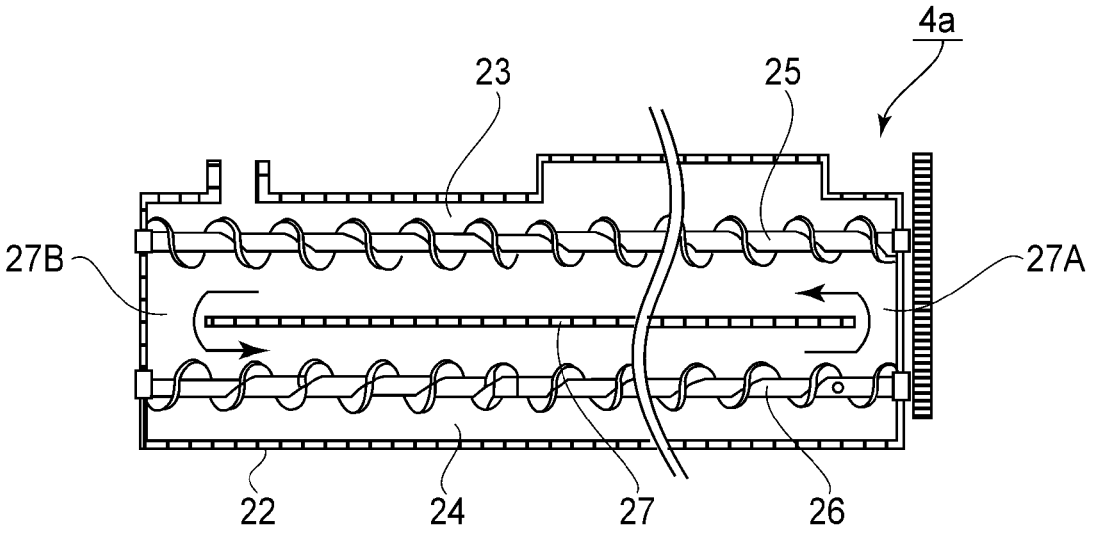
FIG. 3 is a schematic sectional view, at a plane parallel to the lengthwise direction of the device, of a typical developing device (apparatus) to which the present invention is applicable. It shows the general structure of the device.

FIG. 2 is a schematic sectional view of the developing device (apparatus) in the preferred embodiments, at a plane perpendicular to the lengthwise direction of the device, and shows the general structure of the device. FIG. 3 is a schematic sectional view of the developing device (apparatus) in the preferred embodiments, at a plane parallel to the lengthwise direction of the device, and shows the general structure of the device.

Referring to FIG. 2, the developing device 4*a* has a development sleeve 28. It develops an electrostatic image on the photosensitive drum 1*a* by causing its development sleeve 28 to bear developer made up of toner and carrier. The photosensitive drum la is rotated in the direction indicated by an arrow mark R1, at a process speed (peripheral velocity) of 273 mm/sec. The developer which the developing device 4*a* uses is two-component developer, which is a mixture of nonmagnetic toner and magnetic carrier.

The shell 22 of the developing device 4*a* has a development chamber 23 and a developer stirring chamber 24, which are vertically stacked. The development chamber 23 is where the development sleeve 28 is supplied with developer. The developer stirring chamber 24 is where the developer is recovered from the development sleeve 28. The development sleeve 28 is rotatably disposed in the developing device shell 22 in such a manner that the peripheral surface of the development sleeve 28 is virtually in contact with the peripheral surface of the photosensitive drum 1*a*.

Next, referring to FIG. 3, the development chamber 23 and stirring chamber 24, which are formed by partitioning the internal space of the developing device shell 22 with a partition wall 27, are parts of the circulatory passage through which developer is circulated while being stirred. The developer stirring chamber 24 (which hereafter is referred to simply as "stirring chamber") is under the development chamber 23. There is a development screw 25 in the development chamber 23. The screw 25 is rotatably supported. There is a stirring screw 26 in the stirring chamber 24. The screw 26 is rotatably supported. The development screw 25 and stirring screw 26 are opposite in the direction in which they convey developer. Thus, as the two screws 25 and 26 are rotated, the developer in the developing device shell 22 circulates within the shell 22 through the two chambers 23 and 24. The partition wall 27 is provided with a pair of openings 27A and 27B, which are at the lengthwise ends of the partition wall 27, and through which the developer is vertically transferred between the two chambers 23 and 24.

Referring again to FIG. 2, the developing device shell 22 is also provided with an opening 22*a*, which corresponds in position to the development area, that is, the area where the development sleeves 28 opposes the photosensitive drum 1*a*. The development sleeve 28 is rotationally positioned in the development chamber 23 so that the peripheral surface of the development sleeve 28 is partially exposed toward the peripheral surface of the photosensitive drum 1*a* through the opening 22A. The development sleeve 28 is made of a nonmagnetic substance such as aluminum or stainless steel. It is 20 mm in diameter. The diameter of the photosensitive drum 1*a* is 80 mm. The image forming apparatus 100 is structured so that the smallest distance between the peripheral surface of the development sleeve 28 and the peripheral surface of the photosensitive drum 1*a* is roughly 300 μm. Thus, an electrostatic image on the photosensitive drum 1*a* can be developed by the developing device 4*a* while the magnetic brush formed of the developer on the peripheral surface of the development sleeve 28 is in contact with the peripheral surface of the photosensitive drum 1*a*.

The development sleeve 28 and photosensitive drum 1*a* are rotated so that in the development area, the peripheral surface of the development sleeve 28 and the peripheral surface of the photosensitive drum 1*a* move in the same direction, and also, so that the peripheral velocity of the development sleeve 28 is 1.75 times that of the photosensitive drum 1*a*. This ratio between the peripheral velocity of the development sleeve 28 and that of the photosensitive drum 1*a* is desired to be in a range of 1.0-3.0, preferably 1.5-2.0. The greater the peripheral velocity ratio, the higher the development efficiency. However, if it is greater than a certain value, such problems as that toner is scattered, and that developer is acceleratorily deteriorated, are likely to occur. This is why the ratio is desired to be in the abovementioned range.

As developer is borne on the peripheral surface of the development sleeve 28, the developer on the peripheral surface of the development sleeve 28 has to be kept confined in the adjacencies of the peripheral surface of the development sleeve 28. Thus, the magnetic roller 129, the peripheral surface of which has multiple magnetic poles N1, S1, N3, N2, S2 and N3, is non-rotationally disposed in the hollow of the development sleeve 28. More specifically, the magnetic roller 129 is positioned so that its magnetic pole S2, which is the development pole, faces the peripheral surface of the photosensitive drum 1*a* through the development area. The magnetic pole S1 opposes the developer layer regulating blade 30. The magnetic pole N2 is between the magnetic poles S1 and S2 in terms of the circumferential direction of the magnetic roller 129. The magnetic poles N1 and N3 face the development chamber 23 and stirring chamber 24, respectively. The magnetic poles except for the magnetic pole S2, or the development pole, are in a range of 40 mT-70 mT in magnetic flux density, whereas the magnetic pole S2 is 100 mT in magnetic flux density.

The development sleeve 28 is rotated in the direction indicted by an arrow mark R28 while being made to bear developer by the magnetic field of the magnetic roller 29. As the development sleeve 28 is rotated, the crests of the development layer on the peripheral surface of the development sleeve 28 come into contact with the regulating blade 30. Consequently, the developer layer on the peripheral surface of the development sleeve 28 is made uniform in thickness at a preset value.

The developer layer regulating blade 30 is made of a nonmagnetic substance such as aluminum. It is roughly in the form of a long and narrow rectangle. It is positioned so that it extends along the peripheral surface of the development sleeve 28 in the direction parallel to the axial line of the development sleeve 28. It is on the upstream side of the photosensitive drum 1*a* in terms of the rotational direction of the development sleeve 28. As the development sleeve 28 is rotated, both the toner and carrier of in the developer layer on the peripheral surface of the development sleeve 28 are moved past the interface between the developer regulating edge of the regulating blade 30 and the peripheral surface of the development sleeve 28, and are sent to the development area.

The amount by which developer is conveyed to the development area is adjusted by adjusting the gap between the regulating blade 30 and the peripheral surface of the development sleeve 28. That is, as the gap is adjusted, the amount by which the crests of the magnetic blush formed by the developer layer on the peripheral surface of the development sleeve 28 is eliminated, whereby the amount by which the developer is conveyed to the development area is adjusted.

The gap between the developer regulating blade 30 and development sleeve 28 is desired to be in a range of 200-1,000 μm, preferably, 300-700 μm. In the following embodiments of the present invention, it was set to 500 μm, whereby the amount by which developer is allowed to remain coated, per unit area, on the peripheral surface of the development sleeve 28 was regulated to 30 mg/m$^2$ by the developer regulating blade 30.

As the development sleeve 28 is rotated, the two-component developer in the development chamber 23 is borne on the peripheral surface of the development sleeve 28, forming a two-component developer layer on the peripheral surface of the development sleeve 28. Then, as the development sleeve 28 is rotated further, the two-component developer layer is regulated in thickness by the developer regulating blade 30, and then, is conveyed to the development area where the two-component developer layer faces the peripheral surface of the photosensitive drum 1*a*, and develops the electrostatic image on the peripheral surface of the photosensitive drum 1*a* into a visible image, that is, an image formed of toner, by supplying the electrostatic latent image with toner. More specifically, as the two-component developer layer which was made uniform in thickness by the developer regulating blade 30 is made to enter the development area by the rotation of the development sleeve 28, the development layer is made to crest by the magnetic pole S2 of the magnetic roller 29. Thus, the crest of the two-component developer layer brushes the peripheral surface of the photosensitive drum 1*a*.

In order to improve the developing device 4*a* in development efficiency, that is, the ratio by which toner is adhered to the electrostatic image on the photosensitive drum 1*a*, an oscillatory voltage, which is a combination of DC voltage Vdc and AC voltage Vac, is applied as development bias to the development sleeve 28 by an electric power source D28. More specifically, the oscillatory voltage used in the embodiments of the present invention was a combination of −500 V of DC voltage Vdc, and AC voltage Vac which is 800 V in peak-to-peak voltage and 12 kHz in frequency. The choice of the AC and DC voltages does not need to be limited to those in the preferred embodiments.

It has been known that when a developing method such as the one described above which utilizes a magnetic brush formed of two-component developer is used, the application of alternating voltage to a development sleeve generally increases a developing device in development efficiency, which in turn improves an image forming apparatus in image quality. However, the application increases the possibility of the adherence of toner to the white areas of an image areas of the sheet S of recording medium, which are to remain blank. This is why a combination of AC and DC voltages is applied to the development sleeve 28 so that a fog prevention voltage Vback is provided between the DC voltage Vdc applied to the development sleeve 28 and the potential level (potential level of unexposed area of peripheral surface of photosensitive drum 1*a*) of the peripheral surface of the photosensitive drum 1*a*.

<Conventional Magnetic Roller>

Figure 4:
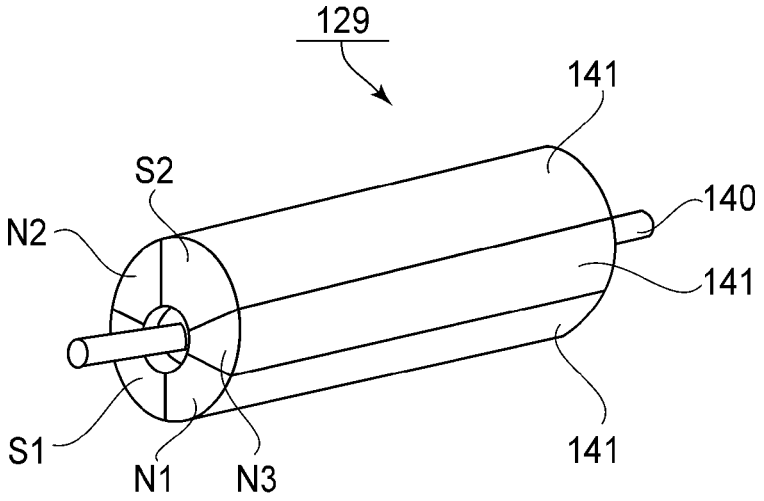
FIG. 4 is a schematic perspective view of a conventional magnetic roller, and shows the structure of the roller.
Figure 5:
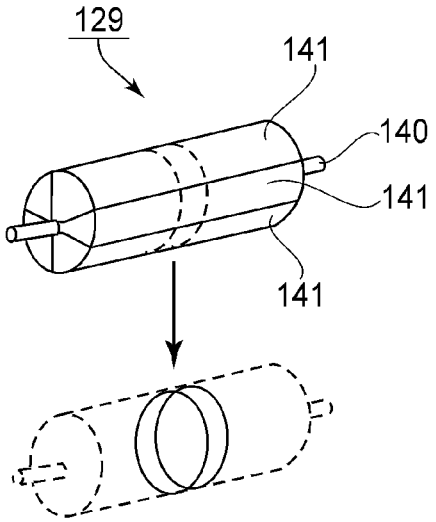
FIG. 5 is a schematic drawing for describing the boundary condition of a magnetic roller.
Figure 6:
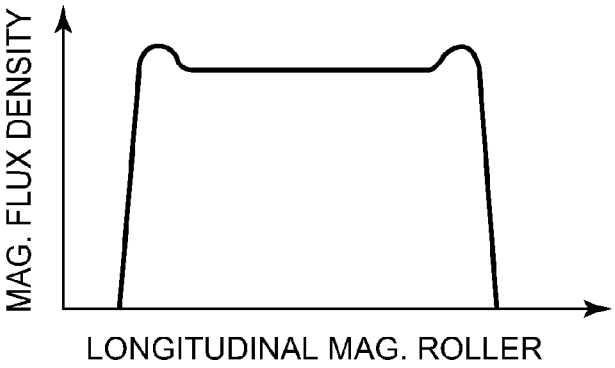
FIG. 6 is a graph of the distribution of the magnetic flux density of a conventional development sleeve, at the peripheral surface of the development sleeve, in terms of the lengthwise direction of the development sleeve.

FIG. 4 is a drawing for describing the structure of a typical conventional magnetic roller. FIG. 5 is a drawing for describing the "boundary condition" of the magnetic roller. FIG. 6 is a drawing for describing the magnetic flux density distribution of the development sleeve 28, at its peripheral surface, in terms of the lengthwise direction of the development sleeve 28.

Referring to FIG. 4, a conventional magnetic roller 129 is made up of a shaft 140 and multiple magnets 141 made of a magnetic substance. The magnets 141 are adhered in parallel to the shaft 140 so that the short edges of each magnet 141 become parallel to the radius direction of the shaft 140. The magnetic roller 129 has to be roughly uniform in cross section, in terms of the magnetic field pattern, across its entire lengthwise range. Therefore, each magnet 141 has been adjusted in magnetism so that it is uniform in magnetic flux density in terms of the direction parallel to the lengthwise direction of the shaft 140.

Next, referring to FIG. 5, to think of the magnetic field of the roller 129 at a given plane which is within the lengthwise range of the roller 129 and perpendicular to the lengthwise direction of the 129, the magnetic force which the magnetic roller 129 forms in the space adjacent to the roller 129 is parallel to the circumferential direction of the roller 129. That is, it is not parallel to the lengthwise direction of the magnetic roller 129, because the magnetic roller 129 is uniform in magnetization in terms of its lengthwise direction, and therefore, the magnetization of the magnetic roller 129 in terms of its lengthwise direction is zero; magnetic force is not generated in the direction parallel to the lengthwise direction of the roller 129. In other words, as long as the magnetic roller 129 is uniform in the magnetic pole arrangement in terms of the lengthwise direction of the shaft 140, periodic boundary condition applies to any plane perpendicular to the peripheral surface of the magnetic roller 129. Therefore, magnetic force is not generated in the lengthwise direction of thee magnetic roller 29, for the following reason. That is, in order for the magnetic fluxes to extend magnetic force to be generated in the lengthwise direction of the magnetic roller 29, symmetry which is necessary for the periodic boundary condition to be applicable is lost, which results in a contradiction.

Therefore, in terms of the lengthwise direction of the magnetic roller 129, the periodic boundary condition can be applied to the most of the magnetic roller 129 except for the end portions. Therefore, the magnetic force is not generated in the direction parallel to the magnetic roller 29. However, the periodic boundary condition does not apply to the lengthwise end portions of the magnetic roller 129. Therefore, when it comes to the lengthwise end portions of the magnetic roller 129, the theory given above does not hold.

At each of the lengthwise ends of the magnetic roller 129, magnetic force is generated in such a direction that magnetic fluxes extend around the edge of the end surface of the magnetic roller 129 and then, toward the center of the end surface. That is, at each of the lengthwise ends of the magnetic roller 129, magnetic force is generated so that the magnetic fluxes extend not only in the direction parallel to the circumferential direction of the magnetic roller 129, but also, in the direction parallel to the lengthwise direction of the roller 129. Therefore, each of the lengthwise ends of the magnetic roller 129 is higher in magnetic flux density than the rest.

Figure 10:
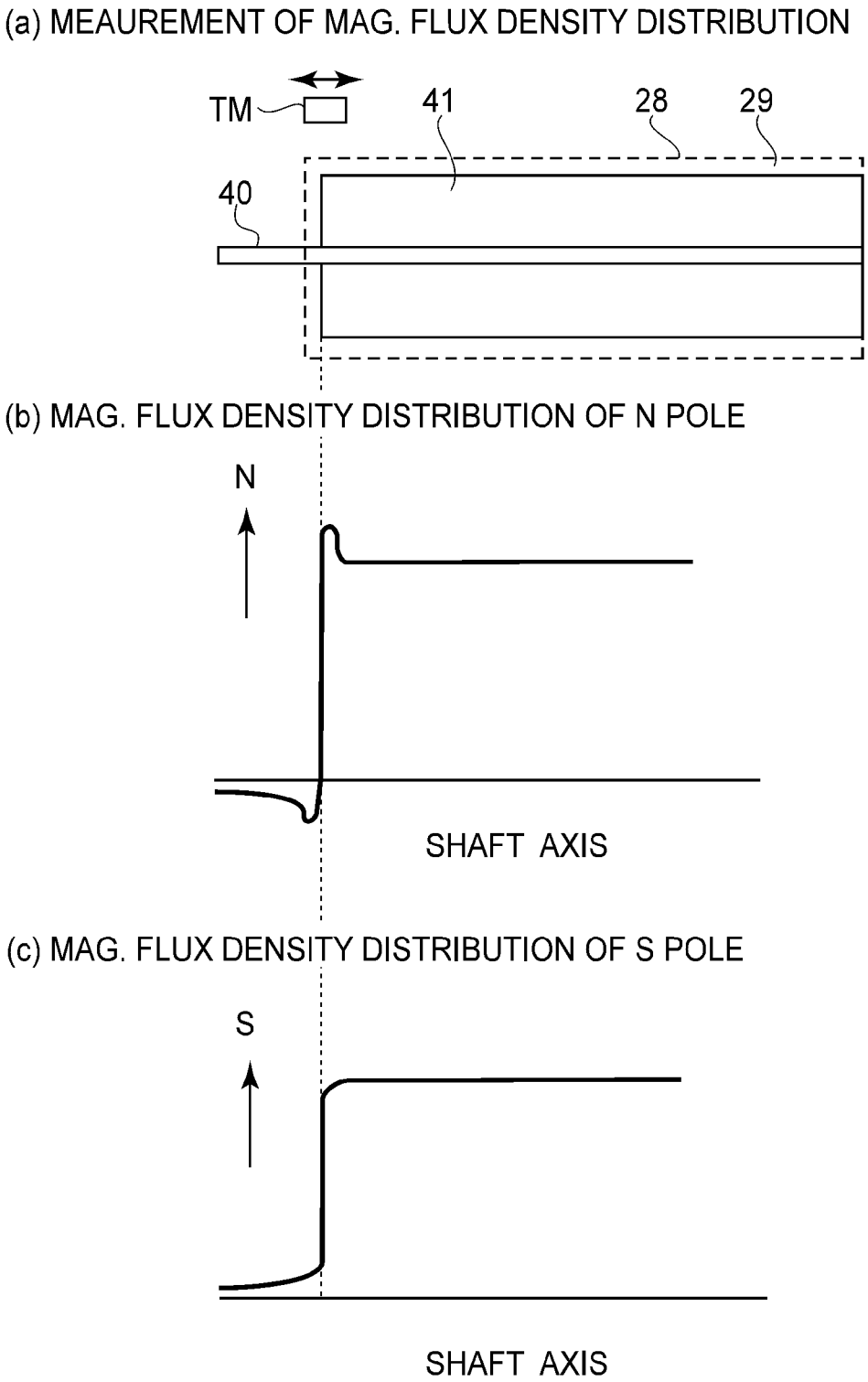
FIG. 10 is a drawing for describing the magnetic flux density distribution of one of the magnetic poles N of a typical conventional magnetic roller, and that of one of the magnetic poles S of the magnetic roller.

Next, referring to FIG. 6, the magnetic flux density of the magnetic roller 29 at the peripheral surface of the development sleeve 28 was measured by moving a Tesla meter (TM: FIG. 10) along the peripheral surface of the development sleeve 28 in the lengthwise direction of the development sleeve 28. The results of the measurement confirmed that the magnetic flux density is significantly higher at the lengthwise ends of the development sleeve 28 than across the rest. This phenomenon is referred to as "edge effect".

The presence of the "edge effect" described above increases the amount by which the developer on the peripheral surface of the development sleeve 28 crests across the areas which correspond in position to the lengthwise ends of the magnetic roller 29. The increase in the amount by which the developer layer crests across a given area of the peripheral surface of the development sleeve 28 increases the amount of the pressure which the developer on this area applies to the peripheral surface of the photosensitive drum 1*a*. If this pressure is greater than a certain value, it is possible for the developer to damage the peripheral surface of the photosensitive drum 1*a*.

Even in a case where the peripheral surface of the photosensitive drum 1*a* is not damaged by the developer in spite of the increase in the abovementioned developer pressure upon the peripheral surface of the photosensitive drum 1*a*, the substantial difference in magnetic flux density between a given area of the peripheral surface of the development sleeve 28 and the adjacent areas, such as the one created by the edge effect between each of the lengthwise end portions of the peripheral surface of the development sleeve 28 and the adjacent area of the peripheral surface of the development sleeve 28, makes the given area substantially different in the amount of the developer from the adjacent area, making thereby the given area substantially different in development efficiency from the adjacent areas. This difference in development efficiency between the given area of the peripheral surface of the development sleeve 28 and the adjacent areas, more specifically, between each of the lengthwise end portions of the development sleeve 28 and the area next to the lengthwise end, is likely to cause the image forming apparatus 100 to output an image which is unsatisfactory in that it is non-uniform in image density.

Further, the increase in the amount by which the developer layer crests makes it easier for the developer to transfer onto the peripheral surface of the photosensitive drum 1*a*, which in turn will possibly affect the drum cleaning device 19*a*, secondary transfer roller 10, fixing device 16, etc., which are on the downstream side of the developing device 4*a* as shown in FIG. 1.

The Tesla meter (TM: FIG. 10) used for the measurement is a device for measuring magnetic flux density. It uses a Hall-effect element. A Hall-effect element is a magnetism sensor, which outputs electrical voltage, the magnitude of which is proportional to the magnetic flux density, based on "Hall effect", which is a phenomenon that as a piece of electrically conductive substance is placed in a magnetic field and electric current is flowed through the piece of electrically conductive substance, in the direction perpendicular to the magnetic field, an electric field which is perpendicular to both the current and magnetic field is generated. When the direction and magnitude of the magnetic field generated by a magnet, and those of the referential current are known, the direction and magnitude of the electromotive force (Hall electric field) can be simply determined with the use of a Hall-effect element. Therefore, the size and direction of the magnetic field perpendicular to the current and electric field can be obtained based on the direction and size of the referential current and electromotive force (Hall electric field).

Comparative Example

Figure 7:
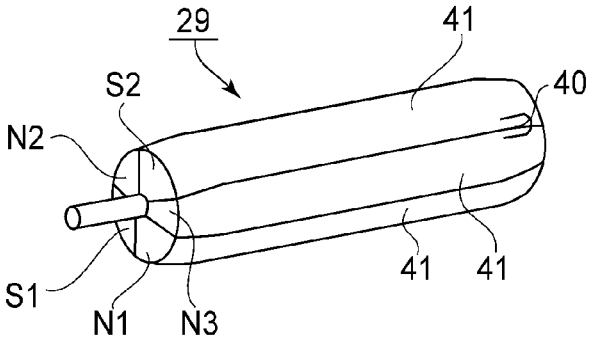
FIG. 7 is a schematic perspective view of a comparative magnetic roller, and shows the structure of the roller.
Figure 8:
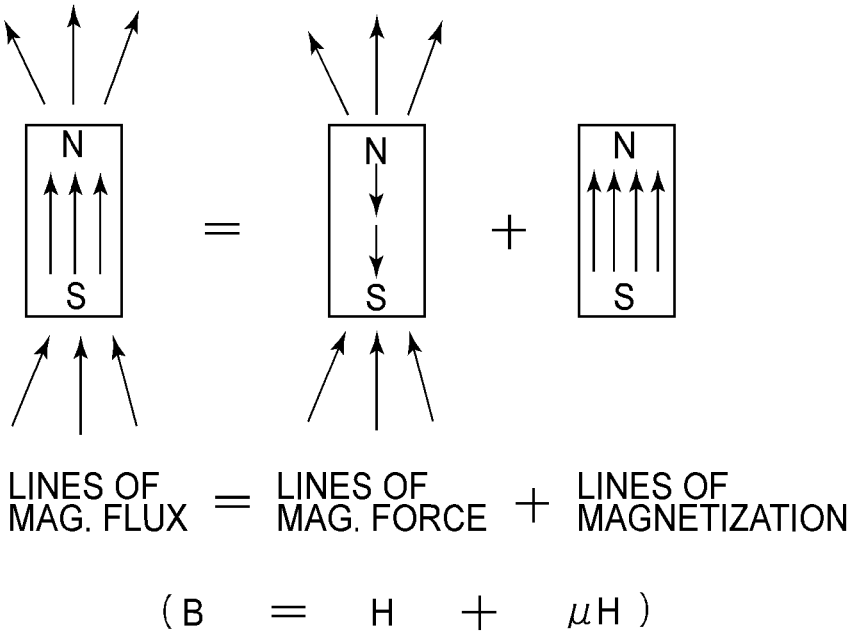
FIG. 8 is a drawing for describing the magnetic fluxes generated by a permanent magnet.
Figure 9:
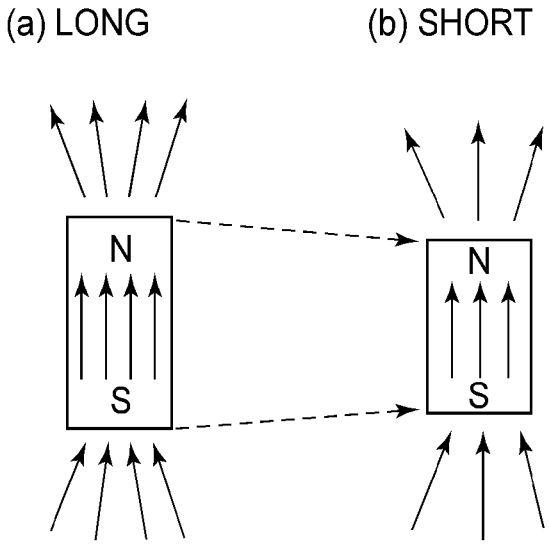
FIG. 9 is a drawing for describing the effects of reducing a permanent magnet in dimension in terms of the direction of magnetization, upon the magnetic fluxes of the permanent magnet.

FIG. 7 is a drawing for describing the structure of one of the comparative magnetic rollers. FIG. 8 is a drawing for describing the magnetic field which a permanent magnet generates. FIG. 9 is a drawing for describing the effect of reducing a permanent magnet in dimension in terms of the magnetization direction of the magnet. FIG. 10 is a drawing for describing the magnetic flux density distribution of the magnetic roller, across one of the lengthwise end portions of one of the magnetic poles N, and the area immediately next to the lengthwise end portion, and the magnetic flux density distribution of the magnetic roller, across one of the lengthwise end portions of one of the magnetic poles S, and the area immediately next to the lengthwise end portion.

According to Japanese Laid-open Patent Applications H01-115109 and H10-91002, in order to make the magnetic roller (29) virtually free of the edge effect, the magnetic roller (29) was structured so that its lengthwise end portions were made smaller in diameter than the rest.

Referring to FIG. 7, in order to provide a magnetic roller which does not suffer from the edge effect, that is, in order to provide a magnetic roller which is uniform in magnetic flux density at its peripheral surface, across its entire range in terms of its lengthwise direction, the magnetic roller 29 was structured so that its lengthwise end portions were smaller in diameter than the rest. The magnetic force of each magnet 41 is correspondent to the volume of the magnet. Therefore, each magnet 41 can be reduced in magnetic flux density by reducing it in volume. Thus, by designing the magnetic roller 29 so that each of its lengthwise end portions gradually reduces in diameter toward the corresponding lengthwise end of the roller 29, it is possible to make the magnetic roller 29 virtually free of the edge effect; it is possible to provide a magnetic roller which does not suffer from the edge effect.

To describe in more detail this subject with reference to FIG. 8, the magnetic flux density of an ordinary permanent magnet is defined as the density of the magnetic fluxes. The magnetic flux may be expressed as the combination (vectorial combination) of line of magnetic force and line of magnetization. This expression corresponds to the fact that magnetic flux density B can be expressed as the sum of magnetic field H and magnetization M (product of multiplication of magnetic field M by permeability p) ($B=H+\mu M$). FIG. 8 shows the relationship among these factors of a rod-shaped magnet.

The magnetic flux satisfies Gauss's Low (divB=0: Equation of magnetic flux preservation) by its very nature. Therefore, there is neither efflux nor influx of magnetic force at any point (same as nonexistence of magnetic charge). That is, if a permanent magnet internally changes by a certain amount in magnetization M, it externally changes in magnetization by an amount equal to the amount of the internal change in magnetization M.

Referring to FIG. 9, therefore, reducing a permanent magnet in volume by changing its length reduces it in magnetization M, which in turn changes the magnetic fluxes in the adjacencies of the permanent magnet so that the adjacencies reduces in magnetic flux density. Thus, in a case where the magnetic roller 29 is structured so that its lengthwise end portions are smaller in external diameter than the rest, the portions of each component magnet 41, which correspond in position to the lengthwise end portions of the magnetic roller 29, are also smaller in volume than the rest, being therefore less in magnetic flux density. Therefore, they are smaller in the amount of the edge effect; they are not significantly higher in magnetic flux density than the rest.

However, the studies made by he inventors of the present invention revealed that even the comparative example of magnetic roller, such as the one described above, still suffers from the following problems. That is, even though the peripheral surface of the comparative magnetic roller 129 described above has the five magnetic poles N1, S1, N2, S2 and N3 as shown in FIG. 7, its lengthwise end portions are simply shaped, with no regard to the presence of the five magnetic poles, so that the closer to the lengthwise end of the roller 29, the smaller the diameter. Therefore, some component magnets 41 display a certain amount of edge effect. Further, if the manner in which the angle of the chamfer of the lengthwise ends of the magnetic roller is gentler than a certain value, some component magnet 41 remain non-uniform in magnetic flux density in terms of the lengthwise direction of the magnetic roller 129.

Referring to FIG. 10(*a*), the magnetic flux density of the comparative magnetic roller 29 was measured with a Tesla meter TM while moving the meter along the peripheral surface of the development sleeve 28, in the lengthwise direction of the development sleeve 28, from one end of the development sleeve 28 to the other. The results of the measurement revealed that the magnetic poles N and S are quite different in characteristic in terms of the magnetic flux density.

Referring to FIG. 10(*b*), the portions of the peripheries of the peripheral surface of the development sleeve 28, which correspond in position to the magnetic poles N1, N2, and N3 of the magnetic roller 29, are significantly higher in magnetic flux density (greater in edge effect) than the rest. More specifically, although they are significantly higher in magnetic flux density than the rest, there is a magnetic field which is opposite (S) in magnetic pole, immediately outward of the lengthwise end of the development sleeve 28. The pattern of the magnetic flux density distribution of this magnetic field is such that it is significantly higher right next to the lengthwise end of the magnetic pole N than across the rest, and converges toward zero in such a manner with the greater the inward distance from the lengthwise end of the development sleeve 28.

In comparison, referring to FIG. 10(*c*), the portions of the peripheries of the peripheral surface of the development sleeve 28, which correspond in position to the magnetic poles S1 and S2, are no higher in magnetic flux density (no greater in edge effect) than the rest. In some cases, they are slightly negative in terms of the edge effect. In the case of the magnetic poles S1 and S2, the pattern of the magnetic flux density distribution is such that it gently converges to zero in such a manner that the greater the outward distance from the lengthwise end of the development sleeve 28, the less the magnetic flux density. Further, in the case of the magnetic poles S1 and S2, the magnetic field on the immediately outward side of the lengthwise end of the development sleeve 28 is not opposite in polarity from the magnetic pole S, and the pattern of the magnetic flux density distribution of this magnetic field also is such that it gently converges to zero in such a manner that the greater the distance from the lengthwise end of the development sleeve 28, the less the magnetic flux density.

As described above, in the case of a magnetic roller, such as the magnetic roller 29, the superficial magnetic poles N and S of which are different in count, the magnetic poles separate into two groups, that is, a group which has virtually no edge effect, and a group which has a significant amount of edge effect. Therefore, if a magnetic roller (20) made up of multiple component magnets 41 positioned so that their magnetic pole N is at the peripheral surface of the magnetic roller, and multiple component magnets 41 positioned so that their magnetic pole S is at the peripheral surface of the magnetic roller, is changed in shape, with no regard to the positioning of the component magnets 41, in such a manner that each of the lengthwise ends of the magnetic roller gradually reduces in diameter toward the lengthwise end of the magnetic roller, each of the component magnets 41, the magnetic pole N of which is at the peripheral surface of the magnetic roller remains a certain amount of edge effect, whereas each of the component magnets 41, the magnetic pole S of which is at the peripheral surface of the magnetic roller becomes negative in edge effects (excessive reduction in magnetic flux density).

As a result, as a given point on each of the lengthwise end portions of the peripheral surface of the development sleeve 28 is moved through the area which corresponds in position to one of the end portions of one of the component magnets 41, the magnetic pole N of which is at the peripheral surface of the magnetic roller, it is increased in the amount by which it can bear developer, because the area is higher in magnetic flux density as described above, and then, as the given point is moved through the next area, that is, the area which corresponds in position to one of the end portions of one of the component magnet 41, the magnetic pole S of which is at the peripheral surface of the magnetic roller, it is reduced in the amount by which it can bear developer, because the area is lower in magnetic flux density as described above. Therefore, in the areas which correspond in position to the lengthwise ends of magnetic roller 29, it is likely for toner (developer) to scatter and/or for carrier to transfer onto the peripheral surface of the photosensitive drum 1*a*. Further, the portions of an electrostatic image on the photosensitive drum 1*a*, which correspond in position to the lengthwise ends of the magnetic roller 29 are likely to be non-uniformly developed.

The reason for the occurrence of the above described problems is that the lengthwise end portions of the magnetic roller 29 were simply changed in diameter, regardless of the fact that the component magnets 41 positioned so that their magnetic pole N is at the peripheral surface of the magnetic roller 29 are different in edge effect from the component magnets 41 positioned so that their magnetic pole S is at the peripheral surface of the magnetic roller 29. In other words, it cannot be said that the structural arrangement for the comparative magnetic roller is satisfactory as the means to deal with the edge effect, that is, the phenomenon that the areas adjacent to the lengthwise end portions of a rod-shaped permanent are significantly higher in magnetic flux density than the area corresponding in position to the rest of the magnet.

Further, a phenomenon such as the above described one can occur even if the number of the superficial magnetic poles N of a magnetic roller is not different from the number of the superficial magnetic poles S of the magnetic roller, unlike the comparative magnetic roller 29. For example, the phenomenon can occur in a case where the adjacent two superficial magnetic poles N of a magnetic roller is different in the amount of magnetization, and also, in a case where the adjacent two superficial magnetic poles of a magnetic roller are different in length in terms of the lengthwise direction of the magnetic roller.

Anyway, if a magnetic roller is provided with multiple superficial magnetic poles in terms of the circumferential direction of the magnetic roller, the magnetic poles separate into a group which is relatively strong in the edge effect, and a group which is not significant in the edge effect. Thus, if a magnetic roller having multiple superficial magnetic poles in terms of the circumferential direction of the magnetic roller is simply reduced in the diameter of its lengthwise end portions, some superficial magnetic poles do not become uniform in magnetic flux density in terms of the lengthwise direction of the magnetic roller. That is, some superficial magnet poles retain a certain amount of the edge effect, or the pattern of the magnetic flux density distribution becomes such that the magnetic flux density gently reduces toward the lengthwise end of the magnetic roller. In other words, if the lengthwise end portions of a magnetic roller are simply reduced in diameter with no regard to the fact that the superficial magnetic poles N of a magnetic roller are different in the edge effect from the superficial magnetic poles S of the magnetic roller, the superficial magnetic poles greater in the edge effect retain a certain amount of the edge effect (magnetic flux density still remains higher in area corresponding in position to lengthwise end portion of magnetic roller than rest). If the area of the peripheral surface of the development sleeve, which corresponds in position to the lengthwise end of the magnetic roller, remains higher or lower in magnetic flux density than the rest, it is possible that various problems will occur.

If the lengthwise end portions of a cylindrical magnetic roller are changed in diameter to compensate for the edge effect of a superficial magnetic pole which is weaker in the amount of the edge effect than the other superficial magnetic poles, the superficial magnetic poles which are stronger in the amount of the edge effect remain a certain amount of the edge effect. If a superficial magnetic pole remains a certain amount of the edge effect, it causes the image forming apparatus 100 to output an image which is non-uniform in density, and/or causes the developer to acceleratedly deteriorate.

On the other hand, if the lengthwise end portions of the magnetic roller are changed in external diameter to accommodate the magnetic poles which are stronger in edge effect, the end portions of the magnetic poles which are intrinsically weak in edge effect are reduced in magnetic force in such a manner that the pattern of the magnetic flux density becomes such that the magnetic force (magnetic flux density) gently reduces too far. Therefore, it is possible that the developer is taken away by the photosensitive drum 1*a*, and/or that as the developer is borne on the peripheral surface of the development sleeve 28, it overspreads in the lengthwise end of the development sleeve 28. Further, the area of the peripheral surface of the development sleeve 28, which corresponds in position to the lengthwise end of the superficial magnetic pole which is less in magnetic flux density (weaker in magnetic force) becomes smaller in the amount by which the developer remains coated on the peripheral surface of the development sleeve 28. Therefore, it is possible that this area will become lower in development efficiency than the rest. Therefore, it is possible that the image forming apparatus 100 outputs an image which is lower in density across the area which corresponds in position to this area.

Thus, in the following preferred embodiments of the present invention, the lengthwise end portions of the magnetic roller 29 were changed in shape so that the lengthwise end portions of each of the component magnets 41 positioned so that their magnetic pole N is at the peripheral surface of the magnetic roller and the lengthwise end portions of each of the component magnets positioned so that their magnet pole S is at the peripheral surface of the magnetic roller are changed in volume according to the pattern and strength of their edge effect.

Embodiment 1

Figure 11:
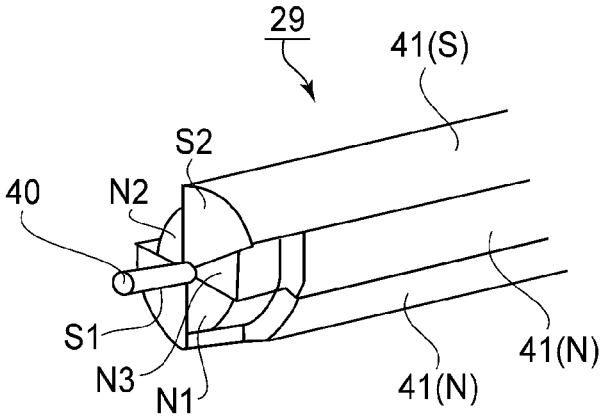
FIG. 11 is a drawing for describing the structure of the magnetic roller in the first preferred embodiment of the present invention.
Figure 11:
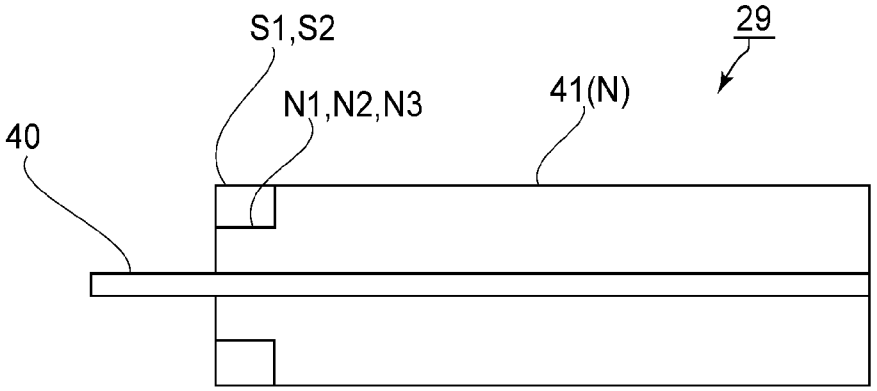

FIG. 11 is a drawing for describing the structure of the magnetic roller in the first embodiment of the present invention. Referring to FIG. 2, the magnetic roller 29, which is an example of a magnetic member, is within the hollow of the development sleeve 28 which is an example of a developer bearing member. It has multiple superficial magnetic poles which are S in polarity and extend in the lengthwise direction of the magnetic roller, and multiple superficial magnetic poles which are N in polarity and extend also in the lengthwise direction of the magnetic roller. It is made up of the magnet supporting shaft 40, and multiple component magnets which are roughly fan-shaped in cross section. It was formed by attaching the multiple component magnets to the magnet supporting shaft in such a manner that some component magnets are positioned so that their magnetic pole N is at the peripheral surface of the magnetic roller, and the other component magnets are position so that their magnetic pole S is at the peripheral surface of the magnetic roller. Hereinafter, a component magnet positioned so that its magnetic pole N is at the peripheral surface of the magnetic roller 29 may be referred to simply as a "component magnet N", whereas a component magnet positioned so that its magnetic pole S is at the peripheral surface of the magnetic roller 29 may be referred to simply as a "component magnet S".

Referring to FIG. 10, in a space which is on the outward side of the magnetic roller 29 and corresponds in position to the axial line of the development sleeve 28, the magnetic polarity toward which the amount of magnetic force converges to zero is the magnetic pole S, which is an example of a negative pole. Therefore, the lengthwise end portions of the component magnets N, which are opposite in polarity from the component magnet S at the peripheral surface of the magnetic roller 29 were made smaller in volume than the lengthwise end portions of the component magnets S. Therefore, a ratio of a volume, per unit length in a longitudinal direction, of a portion of the magnetic roller 29 which has a surface magnetic pole N (a second magnetic polarity) in a longitudinal end portion to that in a longitudinally central portion is smaller than a ratio of a volume, per unit length in a longitudinal direction, of a portion of said magnetic member which has a surface magnetic pole S (a first magnetic polarity) in a longitudinal end portion to that in a longitudinally central portion, as shown in FIG. 11(*a*).

The number of the superficial magnetic poles N of the magnetic roller 29 is greater than that of the superficial magnetic poles S of the magnetic roller 29. Therefore, the lengthwise end portions of each component magnets N were made smaller in volume than the lengthwise end portions of each component magnet S.

In order to minimize the difference in the magnetic flux density between the component magnet N and component magnet S at the corner portion of the lengthwise ends of the magnetic roller 29, the lengthwise end portions of each component magnet were reduced in volume by a preset amount. More specifically, the amount by which the lengthwise end portions of the component magnet N were reduced in volume is greater than the amount by which the lengthwise end portions of the component magnetic S were reduced in volume.

The center portion of the magnetic roller 29 in the first embodiment in terms of the radius direction of the roller 29 is occupied by the component magnet supporting shaft 40, which is circular in cross section. Referring to FIG. 2, the magnetic roller 29 is made up of the five component magnets 41 pasted to the supporting shaft 40, being positioned so that the peripheral surface of the magnetic roller 29 has five magnetic poles N1, S1, N2, S2 and N3.

The present invention is applicable to a magnetic roller other than those described above, even if the magnetic roller is not structured as those in the preferred embodiments. For example, the present invention is applicable to a magnetic roller, the number of the superficial magnetic poles is not five, a magnetic roller formed by one of the methods other pasting multiple component magnet to a component magnet supporting shaft, and the like magnetic rollers.

In the preferred embodiments, the magnet supporting shaft 40 is made of stainless steel. However, the material for the shaft 40 does not need to be limited to stainless steel. That is, it may be any substance as long as it can provide the shaft 40 with a certain amount of rigidity. For example, it may be a metal such as iron. Further, the magnet supporting shaft 40 in the first embodiment was circular in cross section. However, the shaft 40 does not need to be circular.

The component magnet 41 may be any of the know magnets, for example, a magnet made up of a magnetic substance, and resin or rubber, or a magnet formed by sintering a magnetic substance. In the first embodiment, the five component magnets 41 were resinous magnets, which were shaped long and narrow, and roughly fan-shaped in cross section. The magnetic roller 29 was made by pasting the five component magnets 41 to the magnet supporting shaft 40 with the use of adhesive, in such a manner that the flat surfaces of each component magnet 41 become parallel to the radius direction of the magnetic roller 29.

Next, referring to FIG. 4, if each component magnet 41 is shaped so that it is uniform in shape and size in cross section from one lengthwise end to the other (direction parallel to magnet supporting shaft 40), the component magnet 41 suffers from a phenomenon called "edge effect", that is, the phenomenon that the lengthwise end portions of the component magnet 41 are higher in magnetic flux density (greater in magnetic force).

On the other hand, if the lengthwise end portions of the magnetic roller 29 are simply reduced in diameter compared to the rest, as shown in FIG. 7, that is, with no regard to the fact that the magnetic roller 29 is made up of five component magnets 41, more specifically, three component magnets N (41N) and two component magnets S (41S), the lengthwise end portions of each component magnet remain a certain amount of edge effect, being therefore greater in magnetic force (higher in magnetic flux density).

In the first embodiment, therefore, before changing in diameter the lengthwise end portions of the magnetic roller 29, the magnetic flux density of each component magnet in terms of its lengthwise direction was obtained by moving a Tesla meter along the peripheral surface of the development sleeve 28 as shown in FIG. 10(*a*). Then, the lengthwise end portions of each component magnet 41 were designed based on the obtained magnetic flux density distribution.

Among the five component magnets 41 of the magnetic roller 29 in the first embodiment, the three component magnets 41N1, 41N2 and 41N3 having the magnetic poles N1, N2 and N3, respectively, are large in the edge effect, whereas the two component magnets 41S1 and 41S2 having the magnetic poles S1 and S2, respectively, are small in the edge effect. Thus, the lengthwise end portions of each of the component magnets 41N1, 41N2 and 41N3 were reduced in volume by a greater amount than the lengthwise end portions of each of the component magnets 41S1 and 41S2, in order to make each component magnet 41 uniform in magnetic property across the entire range of the magnet 41, regardless of its superficial polarity.

More specifically, referring to FIG. 11(*a*), the lengthwise end portions of each of the component magnets 41N1, 41N2 and 41N3 were made smaller in dimension in terms of the radius direction of the magnetic roller 29, whereas the lengthwise end portions of each of the component magnets 41S1 and S2 were not changed in the dimension in terms of the radius direction of the magnetic roller 29. Therefore, the component magnets 41N1, 41N2 and 41N3, which would have been large in the edge effect, were significantly reduced in the edge effect, and the component magnets 41S1 and 41S2, which would have been small in the edge effect, were prevented from becoming excessively weak in magnetic force (excessively low in magnetic flux density). Thus, the magnetic roller 29 in this first embodiment was uniform in magnetic force (magnetic flux density) from one end to the other, regardless of whether the magnetic flux density was measured across the area of the peripheral surface of the development sleeve 28, the magnetic pole of which is S or N.

Incidentally, in a case where the lengthwise end portions of one of the two component magnets 41S1 and 41S2 display the edge effect, that is, significantly greater in magnetic force (higher in magnetic flux density) than the rest, the lengthwise end portions of only the magnetic component 41S which displays a significantly amount of edge effect are to be reduced in the dimension in terms of the radius direction of the magnetic roller 29. In such a case, if attention is paid so that the lengthwise end portions of the component magnet 41S which shows a significant amount of edge effect will be greater in the dimension in terms of the radius direction of the magnetic roller 29 than the lengthwise end portions of each of the component magnets 41N1, 41N2 and 41N3, the adjacencies of the lengthwise end portions of the peripheral surface of the development sleeve 28 become uniform in magnetic force (magnetic flux density) in terms of the circumferential direction of the development sleeve 28.

In the first embodiment, the component magnets 41N1, 41N2 and 41N3 are made the same in the amount by which they were reduced in volume. However, they may be different in the amount by which they are reduced in volume, according to the difference among them in terms of the amount of edge effect. That is, a component magnet 41 can be reduced in the edge effect by an amount proportional to the amount of its edge effect, by determining the amount by which the lengthwise end portions of the component magnet 41 is to be reduced, based on the amount of its edge effect. That is, the magnetic roller 29 can be reduced in the amount of the overall edge effect by determining the amount by which the lengthwise end portions of each component magnet 41 are reduced in volume, based on the amount of the edge effect of each component magnet 41.

For example, in a case where the component magnet 41N1 is greater in the strength of magnetization than the component magnet 41N2, the former may be smaller in the dimension in terms of the radius direction of the magnetic roller 29 than the latter. However, even though there is a correlation between the strength of the magnetization of a magnet and the amount of the edge effect of the magnet, the correlation may reverse because of the half-width and/or adjacent magnetic pole. Therefore, actually measuring the amount of edge effect of each component magnet 41 as shown in FIG. 10, and determining the amount by which the lengthwise end portions of each component magnet 41 are to be reduced in volume, based on the measured amount of edge effect, can provide better results than determining it based on the correlation between the strength of the magnetization of a magnet and the amount of the edge effect of the magnet.

With the use of the above described method, a magnetic roller, such as the magnetic roller 29 in the first embodiment, which is structured so that the superficial magnetic poles N and S of which are unbalanced in terms of magnetic flux density, can be made uniform in the amount of edge effect in terms of the circumferential direction of the magnetic roller.

By varying the component magnets 41 in the amount by which their lengthwise end portions are reduced in volume, based on the amount of the edge effect of each component magnet 41, it is possible to rid each component magnet 41 of virtually the entirety of its edge effect and can prevent each component magnet 41 from becoming excessively weak in the magnetic flux distribution. Since this method can rid each component magnet 41 of its edge effect and also can prevent each component magnet 41 from becoming excessively gentle in the magnetic flux density distribution, it can improve the development sleeve 28 in the state of cresting of the developer layer, and therefore, can keep the image forming apparatus 100 in the condition in which the apparatus 100 continuously forms excellent images.

Incidentally, in the first embodiment, the material of the component magnets 41 of the magnetic roller 29 was a mixture of resin and a magnetic substance. However, the component magnet 41 may be a ferrite magnet formed by sintering. However, a ferrite magnet formed by sintering has such a shortcoming that it is brittle, being likely to be easily damaged. Further, it is likely to shrink while being sintered. Thus, it is limited in terms of the shape into which it can be formed.

Therefore, in a case where the lengthwise end portions of each of the component magnets of a magnetic roller have to be subtly manipulated in shape to rid each component magnet of the edge effect, a resin magnet, that is, a magnet, the lengthwise end portions of which can be easily changed in shape and/or volume, is preferable as the component magnet for the magnetic roller 29 to a ferrite magnet formed by sintering.

Further, in the first embodiment, the magnetic roller 29 was formed by pasting together multiple component magnets. However, the present invention is applicable to a single-piece magnetic roller. However, from the standpoint of changing in shape and/or volume the lengthwise end portions of each of the multiple sections of a magnetic roller in terms of the circumferential direction of the magnetic roller, a magnetic roller formed by pasting together multiple component magnets 41 is advantageous because it is easier to shape, and also, easier to change in volume its lengthwise end portions.

Further, if the magnet supporting shaft 40 of the magnetic roller 29 is formed of a magnetic substance, the magnetic flux density is unlikely to converge to zero at the lengthwise ends of the magnetic roller 29, for the following reason. That is, if the magnet supporting shaft 40 is formed of a magnetic substance, it is magnetized, and behaves like a magnet. Therefore, the magnet supporting shaft 40 is desired to be formed of a nonmagnetic substance. In the first embodiment, the magnet supporting shaft 40 was formed of stainless steel.

Embodiment 2

Figure 12:
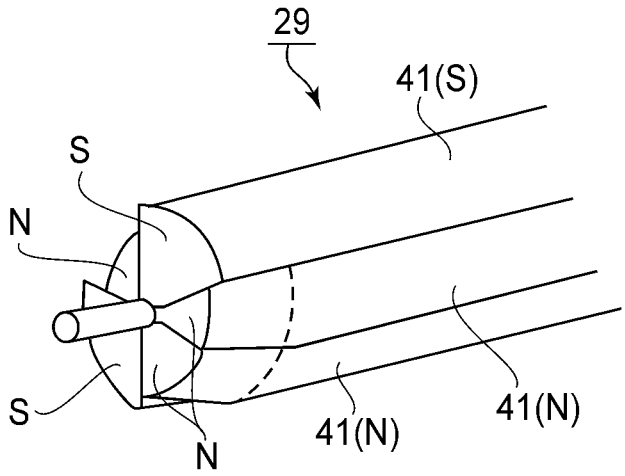
FIG. 12 is a drawing for describing the structure of the magnetic roller in the second preferred embodiment of the present invention.
Figure 12:
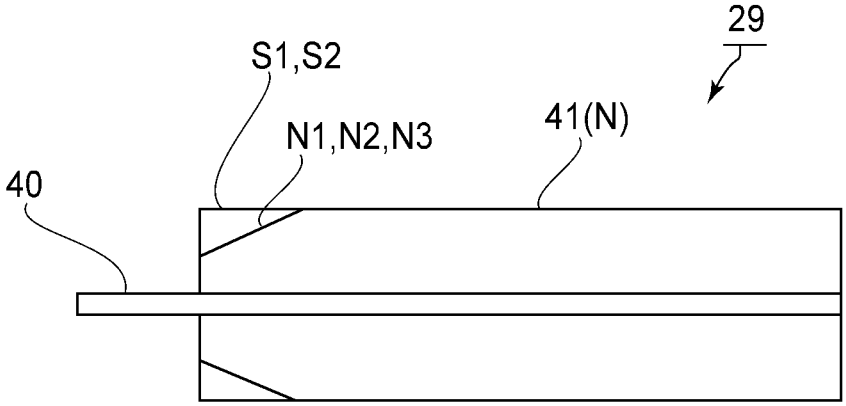

FIG. 12 is a drawing for describing the structure of the magnetic roller in the second embodiment. Referring to FIG. 11, in the first embodiment, the lengthwise end portions of each component magnet were reduced in dimension in terms of the radius direction of the magnetic roller 29, by removing the magnetic substance by a preset thickness from a range between the lengthwise end of the component magnet to a preset point in terms of the lengthwise direction of the magnetic roller. In comparison, in the second embodiment, the lengthwise end portions of each of the selected component magnets 41 were shaped so that the portion of the component magnet, which is between the lengthwise end of the magnetic roller 29 and a preset point of the lengthwise end portion, is tapered toward the lengthwise end of the magnetic roller 29, as shown in FIG. 12.

In addition, the amount by which the lengthwise end portions of each of the component magnets 41N1, 41N2, and 41N3 were reduced in volume was greater than the amount by which the lengthwise end portions of each of the component magnets 41S1 and 41S2 were reduced in volume, like the magnetic roller 29 in the first embodiment. With the use of this method, it is possible to make the lengthwise end portions of the magnetic roller 29 uniform in the amount of edge effect measurable at the peripheral surface of the development sleeve 28. That is, the development sleeve 28 was free of non-uniformity in developer bearing performance in terms of its lengthwise direction as well as its circumferential direction.

Further, reducing in volume the lengthwise end portions of each of the selected component magnets 41 in such a manner that they taper toward the lengthwise ends of the magnetic roller 29 matches the fact that the closer to the lengthwise ends of the magnetic roller 29, the more conspicuous the edge effects. Therefore, this method can make the development sleeve 28 uniform in magnetic force (magnetic flux density) in terms of its lengthwise direction. Further, the lengthwise end portions of the magnetic roller 29 in this embodiment is gentler in sloping, and therefore, are less likely to be damaged while the magnetic roller 29 is manipulated during the production of the magnetic roller 29.

Embodiment 3

Figure 13:
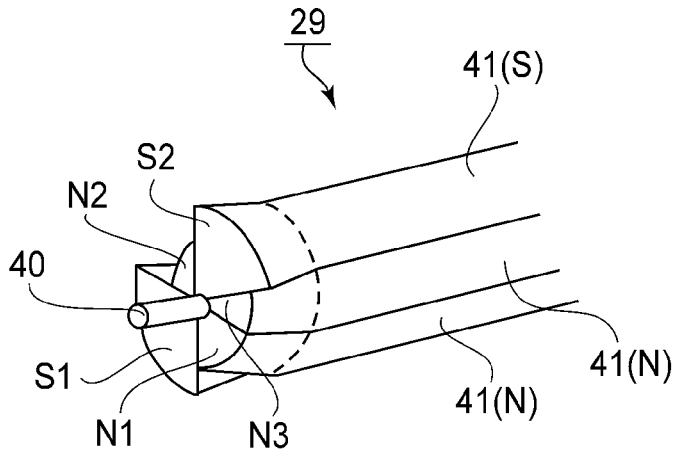
FIG. 13 is a drawing for describing the structure of the magnetic roller in the third preferred embodiment of the present invention.
Figure 13:
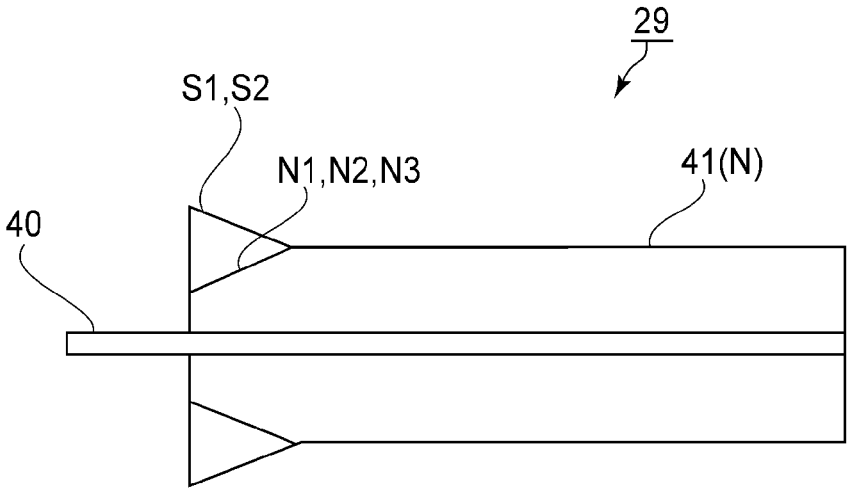

FIG. 13 is a drawing for describing the structure of the magnetic roller in the third embodiment. Referring to FIG. 12, in the second embodiment, the lengthwise end portions of each component magnet 41 were reduced in volume by partially removing their magnetic material by a preset amount. In comparison, in this embodiment, the magnetic material of each component magnet 41 was added to the lengthwise end portions of the component magnet 41 by an amount preset for each component magnet 41.

Of the five superficial magnetic poles of the magnetic roller 29, those smaller in count are the magnet poles S. The lengthwise end portions of each component magnet 40S were given a certain amount of the magnetic material for the magnet 405. Therefore, they are greater than the rest (center portion) in dimension in terms of the radius direction of the magnetic roller 29.

The component magnets 41S1 and 41S2 are significantly weaker in magnetic force (lower in magnetic flux density) across there lengthwise end portions. Therefore, the lengthwise end portions of each of the component magnets 41S1 and 41S2 were increased in magnetization by increasing them in volume, whereby the lengthwise end portions of the magnetic roller 29 were made uniform in the amount of magnetic force (uniform in magnetic flux density) in terms of the circumferential direction of the magnetic roller 29.

Embodiment 4

Figure 14:
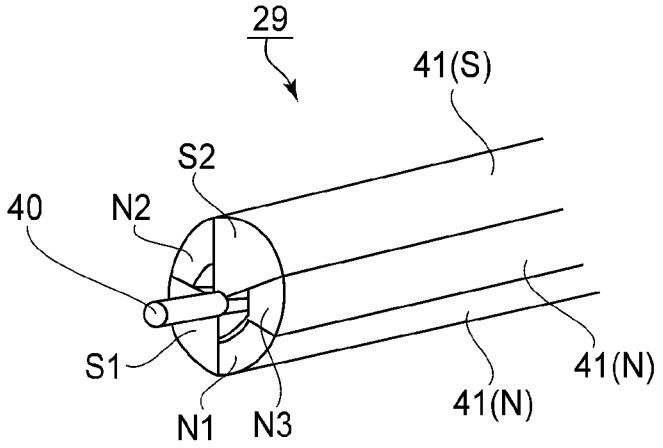
FIG. 14 is a drawing for describing the structure of the magnetic roller in the fourth preferred embodiment of the present invention.
Figure 14:
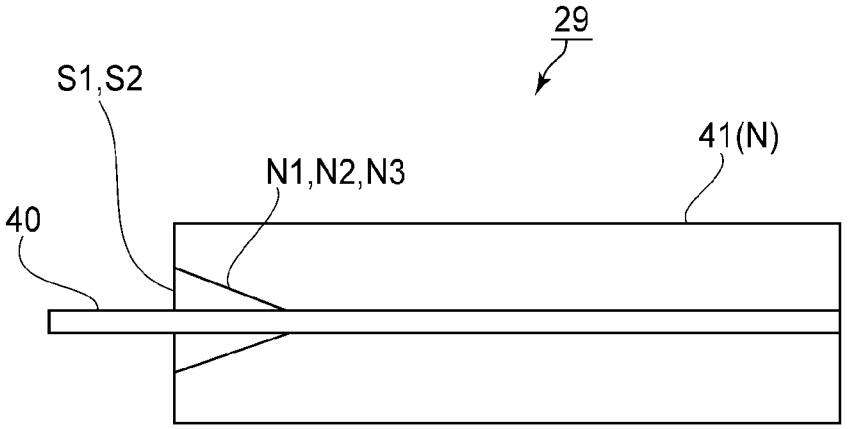

FIG. 14 is a drawing for describing the structure of the magnetic roller 29 in the fourth embodiment. Referring to FIG. 12, in the second embodiment, the magnetic roller 29 was reduced in the amount of the edge effect by reducing in volume the lengthwise end portions of each of its selected component magnets 41 by removing the magnetic substance from the lengthwise end portions. In comparison, in the fourth embodiment, each of the selected component magnets 41 was reduced in the amount of the edge effect by removing the magnetic substance from the inward portions of the lengthwise end portions of each component magnet 41, as shown in FIG. 14. Therefore, the lengthwise end portions of the magnetic roller 29 are smaller in volume than the rest.

It was discovered that in a case where the lengthwise end portions of each of the selected component magnets 41 of the magnetic roller 29 were changed in their dimension in terms of the radius direction of the magnetic roller 29 in order to rid the component magnet of the edge effect, there is a significant amount of difference in magnetic force (magnetic flux density) between the portion of the component magnet, which is greater in dimension in terms of the radius direction of the magnetic roller 29 and the adjacent portion of the component magnet, which is smaller in dimension. The reason for the presence of this significant amount of difference in magnetic force is that the magnetic lines of force (line of magnetic flux) are likely to converge to the border between the two areas of a component magnet, which are significantly different in dimension in terms of the radius direction of the magnetic roller 29. The periodic boundary condition is not present at the border between the two areas of a component magnet, which are significantly different in dimension in terms of the radius direction of the magnetic roller 29. Therefore, at the border, not only do the magnetic lines of force (magnetic flux) extend in the circumferential direction of the magnetic roller 29, but also, they bend in curvature toward the axial line of the magnetic roller 29.

To describe further, it is also related to the fact that the peripheral portion of the magnetic roller 29, that is, the portion of the magnetic roller 29, which is close to the development sleeve 28 were changed in volume. Therefore, it is easier for the magnetic flux density at the peripheral surface of the development sleeve 28 to be affected by the change in the magnetic flux density distribution pattern of the magnetic roller 29.

It is the peripheral surface of the development sleeve 28 that the developer is borne. Therefore, among the magnetic fields which the magnetic roller 29 forms, the one formed at the peripheral surface of the development sleeve 28 is the most important. Therefore, in order to make the portions of the development sleeve 28, which correspond in position to the lengthwise end portions of the magnetic roller 29, uniform in developer bearing performance in terms of the circumferential direction of the development sleeve 28, it is necessary to make the peripheral surface of the development sleeve 28 uniform in the density of the magnetic fluxes which the magnetic roller 29 forms. However, if the lengthwise end portions of the magnetic roller 29 are changed in diameter from the rest, the edge which the adjacent two areas of the magnetic roller 29, which are different in diameter, form between the two areas, will be very close to the peripheral surface of the development sleeve 28. Therefore, the magnetic lines of force (magnetic fluxes) which extend in the lengthwise direction of the magnetic roller 29 bend in curvature toward the axial line of the magnetic roller 29, which in turn affect the magnetic flux density distribution pattern at the peripheral surface of the development sleeve 28. In other words, there will be significant amount of difference in the amount of magnetic force (magnetic flux density) between the two areas of the peripheral surface of the development sleeve 28, which correspond in position to the two areas of the magnetic roller 29, which are significantly different in diameter.

In the fourth embodiment, therefore, the lengthwise end portions of each of the selected component magnets 41, were reduced in the amount of magnetization by removing their center portions, that is, the portions next to the magnet supporting shaft 40. Thus, the magnetic roller 29 was finished cylindrical, that is, uniform in diameter from one end to the other. That is, the characteristic feature of the magnetic roller 29 in this embodiment is that in order to rid the magnetic roller 29 of the edge effect, each lengthwise end portion of the magnetic roller 29 was reduced in volume by removing the center portion of each lengthwise end portion of the magnetic roller 29, instead of the peripheral portion.

Referring to FIG. 14, the magnetic roller 29 in this embodiment was made up of the magnetic supporting shaft 40, and multiple component magnets 41 which are roughly fan-shaped in cross section. More specifically, it was formed by positioning the multiple component magnets 41 around the magnet supporting shaft in such a manner that the two lateral flat surfaces of each component magnet 41 become parallel to the radius direction of the magnetic roller 29. The lengthwise end portions of each of the selected component magnets 41 were reduced in volume by removing the magnetic material from the center portions of each lengthwise end portion of the selected component magnet 41, that is, the portions next to the magnet supporting shaft 40.

Also in the fourth embodiment, each of the selected component magnets 41 of the magnetic roller 29 were reduced in the amount of the edge effect (phenomenon that lengthwise end portions of magnet is significantly stronger in magnetic force (higher in magnetic flux density)) by reducing in volume the lengthwise end portions of each of the selected component magnets 41 by removing the magnetic material. Even through the center portion of each of the lengthwise end portions of each of the selected component magnets 41 was removed instead of the peripheral portion, the lengthwise end portions of the component magnet 41 were smaller in volume. That is, the lengthwise end portions of a component magnet 41 can be reduced in the amount of the magnetic flux density in its adjacencies by removing the peripheral portion of the lengthwise end portion of the component magnet 41 as effectively as by removing the center portion of the lengthwise end portion of the component magnet 41.

Therefore, a magnetic roller can be reduced in the amount of edge effect, that is, the intrinsic effect which the lengthwise ends of a permanent magnet has, by structuring the magnetic roller like the magnetic roller 29 in the fourth embodiment. That is, a magnetic roller can be made uniform in magnetic force (magnetic flux density) from one lengthwise end to the other by structuring it like the one in the fourth embodiment.

Further, in the fourth embodiment, the magnetic roller 29 is cylindrical and uniform in diameter from one end to the other. Therefore, unlike a magnetic roller (29), the lengthwise end portions of which were non-uniformly changed in the dimension in terms of the radius direction of the roller, no point on the magnetic roller 29 in terms of the lengthwise direction of the magnetic roller 29 was significantly higher in magnetic flux density than the rest. Also in the fourth embodiment, the magnetic lines of force bend in curvature toward the axial line of the magnetic roller 29, in the area which corresponds in position to where the center portion of the lengthwise end portion of the component magnet 41 in terms of the radius direction of the magnetic roller 29 was removed. However, there is a significant amount of distance between where the magnetic lines of force bend in curvature toward the axial line of the magnetic roller 29, and the peripheral surface of the development sleeve 28. Therefore, the peripheral surface of the development sleeve 28 is hardly affected by the bending of the magnetic lines of force. That is, in the fourth embodiment, unlike the embodiment in which the lengthwise end portions of the magnetic roller 29 was changed in external diameter, no point on the magnetic roller 29 in terms of the lengthwise direction of the magnetic roller 29 was significantly higher in magnetic flux density than the rest.

Further, in the fourth embodiment, the lengthwise end portions of only the component magnets 41N1, 41N2, and 41N3, which would have been stronger in the edge effect, were reduced in volume; lengthwise end portions of the component magnets 41S1 and 41S2, which were weaker in the edge effect were not reduced in volume. Therefore, the magnetic roller 29 was uniform in magnetic force (magnetic flux density) in terms of the circumferential direction of the roller 29 even though the component magnets 41 were different in the amount of edge effect prior to the modification.

<Reason Why Component Magnet 41N is Different in Edge Effect from Component Magnet 41S>

Referring to FIGS. 10(*b*) and 10(*c*), in the immediately outward area of each of the lengthwise end surface of the magnetic roller 29, the magnetic flux density distribution is on the S side, regardless of whether the superficial magnetic polarity is N or S, and gradually converges toward zero. The reason why the magnetic flux density distribution converges toward zero from the S side regardless of whether the superficial magnetic polarity is N or S, is thought to be as follows:

A component magnet 41N is positioned so that its magnetic pole N is at the peripheral surface of the magnetic roller 29 (being close to development sleeve 28). In other words, the inward side of the component magnet 41N in terms of the radius direction of the magnetic roller 29, which is in contact with the magnet supporting shaft 40, is S in magnetic pole, because there is no permanent magnet which has only one magnetic pole. Similarly, the inward side of a component magnet 41S is N in magnetic polarity. Further, regarding the bending in curvature of the magnetic lines of force (magnetic fluxes) toward the axial line of the magnetic roller 29 at each of the lengthwise ends of the magnetic roller 29, the magnetic lines of force extend mainly from one of the superficial magnetic poles, and bend in curvature toward the axial line of the magnetic roller 29.

To think about the characteristics of the magnetic roller 29 in terms of its magnetism at its lengthwise ends, the magnetism in the immediately outward adjacencies of the lengthwise ends of the magnetic roller 29 converges to either the magnetic pole N or S. Whether the magnetic field converges to the magnetic pole N or S is determined by the balance among the magnetic poles adjacent to the magnet supporting shaft 40 of the magnetic roller 29, for the following reason.

That is, the magnetic lines of force (magnetic fluxes) from a superficial magnetic pole of a component magnet 41 are likely to extend in the circumferential direction of the magnetic roller 29, whereas the magnetic lines of force (magnetic fluxes) from the magnetic pole of the inward side of a component magnet 41 are likely to extend in the direction parallel to the magnet supporting shaft 40. Therefore, the balance among the magnetic poles of the inward side of the component magnets 41 affects the characteristics of the magnetism in the immediately outward area of each lengthwise end of the magnetic roller 29 in terms of the lengthwise direction of the magnetic roller 29.

To observe the comparative magnetic roller in FIG. 7 from the above described point of view, there are five magnetic poles, that is, three magnetic poles N and two magnetic poles S, in the peripheral surface of the magnetic roller 29. On the other hand, there are three magnetic poles S (opposite magnetic pole to magnetic pole N), and two magnetic poles N (opposite magnetic pole to magnetic pole S) on the inward side of the component magnets 41 (at peripheral surface of magnet supporting shaft 40). In other words, on the inward side of the component magnets 41, the magnetic poles S win in terms of numerical balance.

This is why it was thought that the magnetic flux density distribution of the magnetic roller 29 converges toward zero from the magnetic pole S side, in the immediate outward adjacencies of the lengthwise end surface of the magnetic roller 29, regardless of whether the magnetic pole is N or S.

In a case where the magnetic flux density distribution of the magnetic roller 29 converges from the magnetic pole S toward zero, in the immediately outward adjacencies of the lengthwise end surface of the magnetic roller 29, as the magnetic lines of force of a component magnet 41 bend in curvature toward the magnet supporting shaft 40 at the lengthwise ends of the component magnet 41, they converge toward the magnetic pole S, in the immediately outward adjacencies of the lengthwise end surfaces of the magnetic roller 29, regardless of whether the magnetic lines of force extend from the magnetic pole N or S.

Therefore, in the case of a component magnet 41N, it is easier for its magnetic lines of force (magnetic fluxes) to extend toward the magnet supporting shaft 40, because they have to extend toward the magnetic pole which is opposite in polarity, and therefore, a component magnet 41N is stronger in the magnetic effect than a component magnet 41S. In comparison, in the case of a component magnet 41S, it is difficult for its magnetic lines of force to extend toward the magnet supporting shaft 40, because they have to extend toward the magnetic pole which is the same in polarity. Therefore, a component magnet 41S is relatively weak in the edge effect. In some cases, the magnetic force (magnetic flux density) gradually reduces toward the lengthwise end.

In the case of a magnetic roller having multiple superficial magnetic poles, its magnetic poles separate into two groups, that is, a group which has virtually no edge effect, and a group which has a significant amount of edge effect. This phenomenon occurs because the magnetic lines of force of each component magnet eventually converge to either the magnetic poles N or S in the immediately outward adjacencies of the ends of the magnetic roller 29 in terms of the lengthwise direction of the magnet supporting shaft 40, regardless of whether the magnetic lines of force extend from the magnetic pole N or S.

Calling, as a "convergence polarity", the polarity of the magnetic pole to which the magnetic lines of force converge in the immediately outward adjacencies of the lengthwise ends of the magnetic roller 29, the magnetic pole, the magnetic polarity of which is different from the "convergence polarity" is likely to be strong in edge effect, whereas the magnetic pole, the magnetic polarity of which is the same as the "convergence polarity" is likely to be weak in edge effect.

Whether the magnetic lines of force converge to the magnetic pole N or S is determined by the numerical balance between the magnetic poles N and magnetic poles S. That is, they converge to the magnetic pole which is greater in numerical balance. In reality, the magnetic pole to which the magnetic lines of force easily converge can be known by measuring the magnetic flux density in the immediately outward adjacencies of the lengthwise ends of the magnetic roller, with the use of a Tesla meter.

The present invention is related to a magnetic roller made up of a center shaft, and multiple component magnets positioned around the center shaft. The magnetic polarity of each of the superficial magnetic poles of the magnetic roller is determined by measuring the magnetic field which is perpendicular to the shaft of the magnetic roller and is parallel to the circumferential direction of the magnetic roller, among the various magnetic fields the magnetic roller forms. In this case, if the magnetic field of a magnetic pole is such that its magnetic lines of force extend away from the shaft of the magnetic roller, the magnetic pole is N in polarity, whereas if the magnetic field of a magnetic pole is such that its magnetic lines of force extend toward the shaft, the magnetic pole is S in polarity.

According to the present invention, if a magnetic member of a developing device (apparatus) is left cylindrical and uniform in diameter from one lengthwise end to the other, and a given component magnet of the magnetic member is higher in magnetic flux density than a component magnet which is different in polarity from the given component magnet, the lengthwise end portion of this component magnet are reduced in volume. That is, the magnetic member is shaped so that the lengthwise end portions of the component magnet are made smaller in volumetric ratio relative to the rest to reduce them in the amount of magnetization. On the other hand, if a given component of the magnetic member is lower in magnetic flux density than a component magnet which is different in polarity from the given component magnet, the lengthwise end portions of this component magnet are increased in volumetric ratio relative to the rest to make the lengthwise end portions close in the amount of magnetization to those of the other component magnets. That is, a developing device (apparatus) in accordance with the present invention employs a magnetic member, the external appearance of which is as described above.

For example, the difference in the amount of in magnetic flux density among the lengthwise end portions (corner portions) of the multiple component magnets of a magnetic member can be reduced by removing the magnetic material from the lengthwise end portions by the amount preset for each component magnet. With the use of this method, the portions of the peripheral surface of the developer bearing member, which correspond in position to the lengthwise end portions of each component magnet of the magnetic member, can be reduced in the amount of the developer confining force by the proper amount for each component magnet.

Therefore, the developer sleeve can be reduced in non-uniformity in developer bearing performance, in terms of the lengthwise direction, as well as the circumferential direction, of the magnetic member, by reducing the amount of difference in magnetic flux density between the area of the peripheral surface of the developer bearing member, which corresponds in position to the component magnet N and that which corresponds in position to the component magnet S.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 021462/2011 filed Feb. 3, 2011 which is hereby incorporated by reference.

What is claimed is:

1. A developing apparatus comprising:

a developer carrying member for carrying a developer; and a magnetic member including a plurality of magnet pieces disposed inside said developer carrying member along a circumferential direction of said developer carrying member, wherein said magnetic member includes one or more first magnet pieces having a first magnetic polarity at a surface opposing an inner surface of said developer carrying member, and one or more second magnet pieces having a second magnetic polarity, which is opposite of the first magnetic polarity, at a surface opposing the inner surface of said developer carrying member, wherein in a longitudinally central portion of said magnetic member, a ratio of a total sum of volumes occupied by said one or more first magnet pieces per unit length is larger than a ratio of a total sum of volumes occupied by said one or more second magnet pieces per unit length, and wherein the ratio of the total sum of the volumes occupied by said one or more first magnet pieces per unit length in a longitudinally end portion is smaller than that in the longitudinally central portion.

2. An apparatus according to claim 1, wherein the total sum of the volumes occupied by said one or more first magnet pieces in the longitudinally end portion is smaller than that in the longitudinally central portion.

3. An apparatus according to claim 1, wherein a part of the volume of said magnetic member in a radially central side is smaller in the longitudinal end portion than in the longitudinally central portion.

4. An apparatus according to claim 1, wherein said magnetic member is tapered such that a part of a volume of said magnetic member in a radially central side decreases toward the longitudinal end portion.

5. A developing apparatus comprising:

a developer carrying member for carrying a developer; and a magnetic member provided inside said developer carrying member and having magnetic poles arranged in a circumferential direction of said developer carrying member, wherein a part of a volume of said magnetic member in a radially central side is smaller in a longitudinal end portion than in a longitudinally central portion, and wherein a configuration of an outer periphery of said magnetic member in the longitudinally central portion is substantially the same as that in the longitudinal end portion.

6. A developing apparatus comprising:

a developer carrying member for carrying a developer; and a magnetic member including a plurality of magnet pieces disposed inside said developer carrying member along a circumferential direction of said developer carrying member, wherein said magnetic member includes one or more first magnet pieces having a first magnetic polarity at a surface opposing an inner surface of said developer carrying member, and one or more second magnet pieces having a second magnetic polarity, which is opposite of the first magnetic polarity, at a surface opposing the inner surface of said developer carrying member, wherein in a region longitudinally outside of an end portion of said magnetic member on a central axis of said magnetic member, a magnetic field has the second polarity, and wherein a ratio of a total sum of volumes occupied by said one or more first magnet pieces per unit length in a longitudinally end portion is smaller than that in a longitudinally central portion.

7. An apparatus according to claim 6, wherein the total sum of volumes occupied by said one or more first magnet pieces in the longitudinally end portion is smaller than that in the longitudinally central portion.

8. An apparatus according to claim 6, wherein a part of the volume of said magnetic member in a radially central side is smaller in the longitudinal end portion than in the longitudinally central portion.

9. An apparatus according to claim 6, wherein said magnetic member is tapered such that a part of a volume of said magnetic member in a radially central side decreases toward the longitudinal end portion.

* * * * *